US005165148A

United States Patent [19]

Fleischer et al.

[11] Patent Number: 5,165,148

[45] Date of Patent: Nov. 24, 1992

[54] TOGGLE CLAMP WITH LOCKING MECHANISM

[75] Inventors: Walter Fleischer, Frankfurt am Main, Fed. Rep. of Germany; Henry Dykstra, Milford, Mich.

[73] Assignee: Delaware Capital Formation, Inc., Wilmington, Del.

[21] Appl. No.: 804,993

[22] Filed: Dec. 11, 1991

[30] Foreign Application Priority Data

Dec. 15, 1990 [DE] Fed. Rep. of Germany ... 9016964[U]

[51] Int. Cl.[5] ..... A44B 21/00; E05C 5/00

[52] U.S. Cl. ..... 24/494; 24/495; 24/68 CD; 292/113

[58] Field of Search ..... 24/494, 493, 495, 496, 24/68 CD; 269/228; 292/247, 113, DIG. 31; 70/76

[56] References Cited

U.S. PATENT DOCUMENTS

| | | | |
|---|---|---|---|
| 1,002,901 | 9/1911 | Christman | 24/68 CD |
| 1,761,570 | 6/1930 | Komenak | 70/76 |
| 1,907,432 | 5/1933 | Mears et al. | 292/113 |
| 1,915,492 | 6/1933 | Hennicke | 292/113 |
| 3,019,043 | 1/1962 | Woodworth et al. | 292/113 |
| 3,297,348 | 1/1967 | Griffiths et al. | 292/113 |
| 3,346,929 | 10/1967 | Webb | 269/228 |
| 3,924,844 | 12/1975 | Bachtel, Jr. | 269/94 |
| 4,743,052 | 5/1988 | Stammreich et al. | 292/113 |

FOREIGN PATENT DOCUMENTS

| | | | |
|---|---|---|---|
| 0323280 | 1/1930 | United Kingdom | 70/76 |

*Primary Examiner*—Victor N. Sakran
*Attorney, Agent, or Firm*—Lloyd M. Forster

[57] ABSTRACT

Toggle clamps with bifurcated handle actuated to aligned toggle element clamping position with manually releasible latch lock lever pivotally mounted between handle sides resiliently engaging base mounted catch upon handle reaching toggle alignment.

11 Claims, 3 Drawing Sheets

TOGGLE CLAMP WITH LOCKING MECHANISM

BACKGROUND OF THE INVENTION

Industrial toggle clamps are frequently subjected to vibration, inverted positioning, slightly short of center clamping, or other variable conditions which may cause the clamp to inadvertently unlock and release the workpiece with potential hazard or damage.

It is known in the art to provide a manually releasible latch lock to engage upon actuating the clamp to its operative position, such as in holding a workpiece, subject to auxilliary handle lever release to permit opening of the clamp. The closest known prior art comprises a toggle clamp, disclosed as prior art in the drawings, wherein an extension of folded sheet metal riveted to both sides of a central handle houses a pivoted latch element and leaf wherein spring reacting against surfaces of the handle to preposition the latch for engaging a base mounted latch pin upon actuating the clamp handle to a clamping position subject to release by manual finger actuation of a release lever, together with hand engagement of the clamp handle.

Another prior toggle clamp with releasible locking means is disclosed in U.S. Pat. No. 3,924,844 wherein a flat leaf spring lock welded to the handle may be released by a trigger member.

BRIEF DESCRIPTION OF THE PRESENT INVENTION

Improvements in releasible latch locking of a toggle clamp are disclosed in the present application which include incorporation of a release lever between two sides of various bifurcated toggle handles; adapting a finger releasible latch lock to pull and straight line action clamps; incorporation of catch in subbase plate provided under standard base; and the mounting of release lever on pivot cross pin.

Satisfactory operation involves a number of coordinated requirements: a suitable pivotal mounting for the release lever; integral catch and finger engageable extension; means for prepositioning the release lever for automatic ramp or cam actuated catch engagement upon handle actuation to clamping position; resilient means for providing catch engagement; and convenient positioning for finger actuation combined with manual release of the clamp.

DETAILED DESCRIPTION OF PRIOR ART CLAMP

Figure 1:
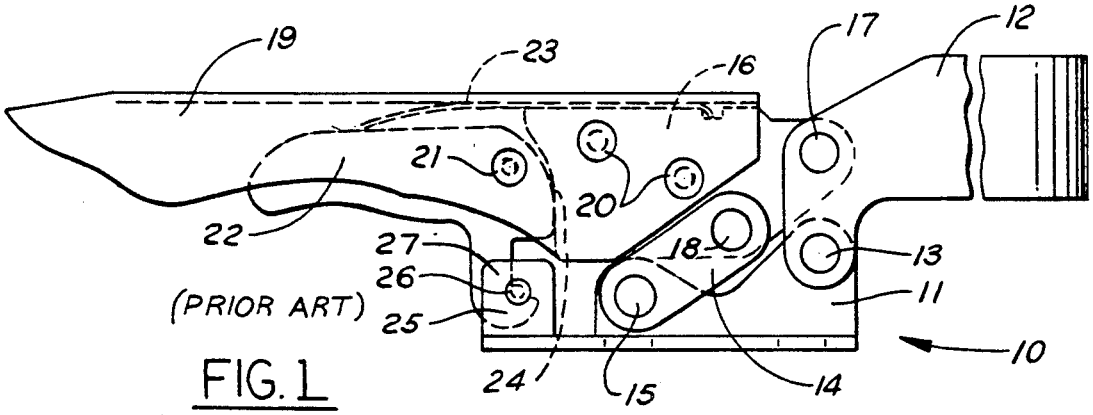
FIG. 1 is a side elevation of prior art clamp.

With reference to FIG. 1, the prior art hold down toggle clamp with latch catch and release lever comprises base 10 with central upstanding mounting element 11 for bifurcated arm 12 pivotally connected thereto at 13 and a pair of link elements 14 pivotally connected thereto at 15. Central toggle actuating element 16 is pivotally connected at 17 to arm 12 and pivotally connected at 18 to the pair of links 14. Handle extension 19, formed as a sheet metal element folded over either side of actuating element 16 and riveted thereto at 20, provides a pivoted mounting at 21 for release lever 22 urged by release leaf spring 23 into prepositioning engagement at 24 with actuating element 16 and having latch catch extension 25 engageable with crosspin 26 in base extensions 27. Intended actuation of the latch catch requires camming of catch extension 25 against cross pin 26 upon downward actuation of handle 19 against resistance of leaf spring 23. This requires a critical degree of accuracy in the relation of rivet connections 20, pivot 21, stop registration 24 and camming surfaces of extension 25 and cross pin 26.

Figure 2:
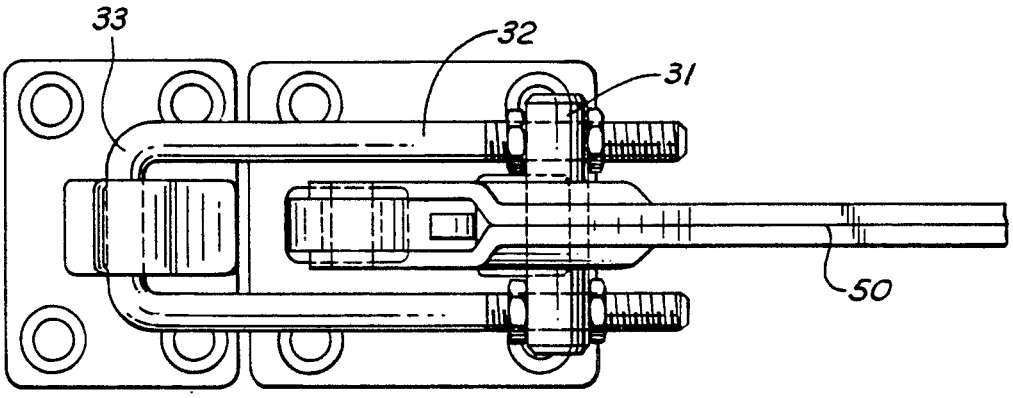
FIG. 2 is a plan view of a pull action clamp incorporating a latch lock in accordance with the present invention.
Figure 3:
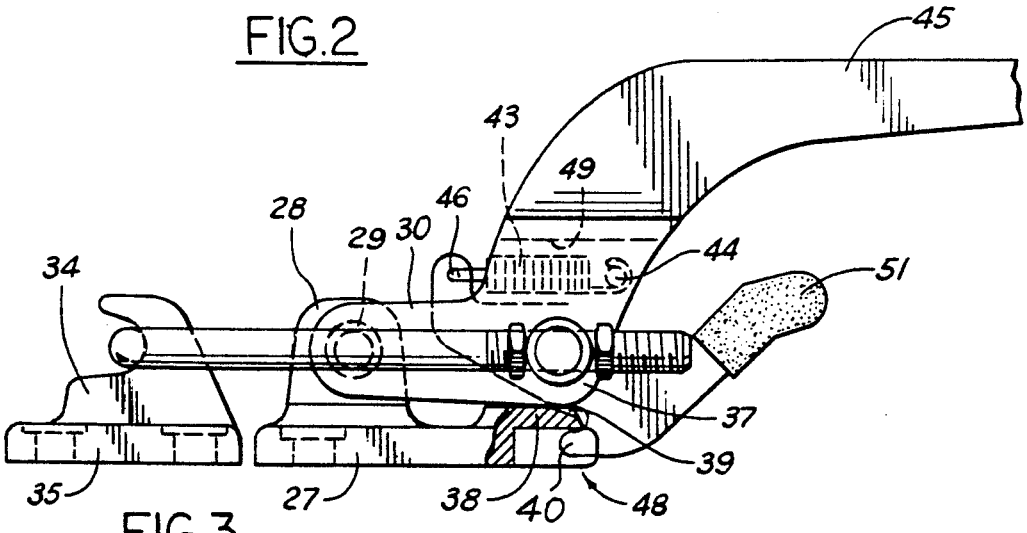
FIG. 3 is a side elevation of the clamp illustrated in FIG. 2.
Figure 4:
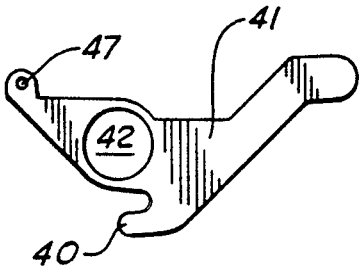
FIG. 4 is a side elevation of the latch element per se shown assembled in FIG. 3.

With reference to FIGS. 2–4, base 27 includes integral upright 28 for pivotal connection at 29 to bifurcated handle extensions 30 having through pin 31 secured therein for adjustable U-bolt 32 having hook end 33 engageable with separate chamber door or mold closure element 34 having its own base 35. Pad 38 on base 27 provides a stop for bifurcated handle ends 37 spanning central latch projection with ramp surface 39 for deflecting knob 40 of latch lever 41 having pivot aperture 42 for mounting on cross pin 31. Tension spring 43 having one end anchored on pin 44 seated in bifurcated ends of handle 45 has its other end 46 engaging extension 47 to pivotally urge lever 41 into latching engagement with knob 40 projecting into recess 48. Prepositioning of lever 41 when clamp handle 45 is raised in disengaged attitude is effected by registration of the top surface of spring 43 with converging sides of handle 45 indicated at 49 and shown in abutting relation at 50 in FIG. 2. Release handle extension 51 is conveniently positioned under handle 45 for finger release actuation upon lifting the handle 45.

Figure 5:
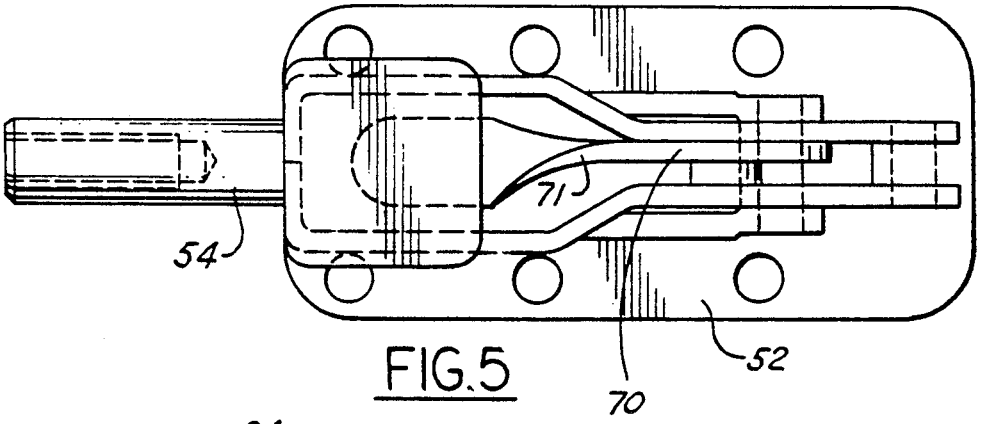
FIG. 5 is a plan view of a straight line action toggle clamp incorporating an alternative latch lock in accordance with the present invention.
Figure 6:
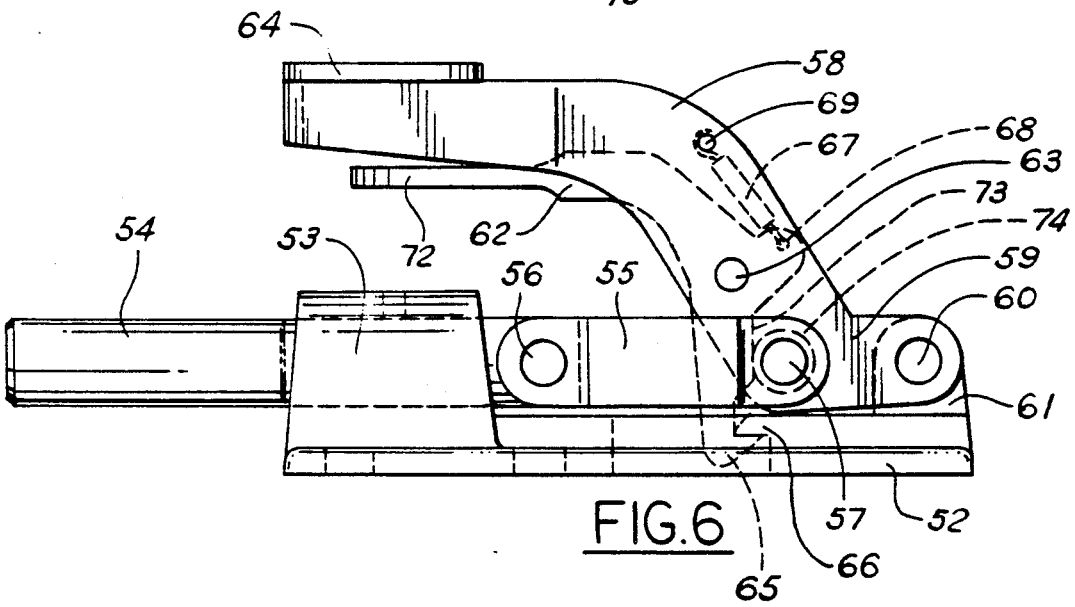
FIG. 6 is a side elevation of the clamp shown in FIG. 5.
Figure 7:
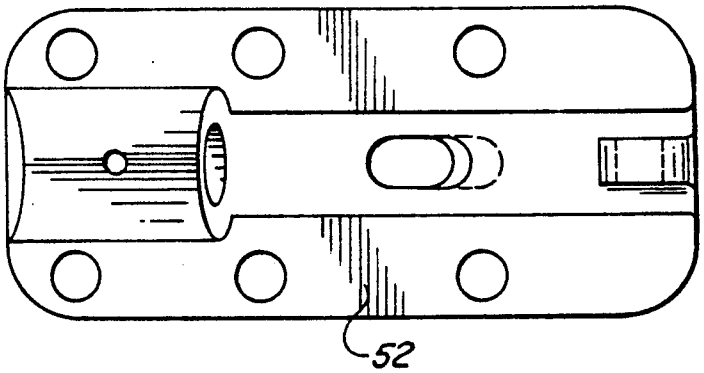
FIG. 7 is a plan view of the base element per se shown assembled in FIG. 5.
Figure 8:
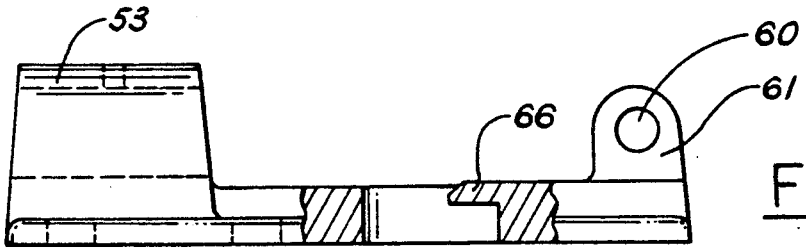
FIG. 8 is a side elevation of the base element shown in FIG. 7.

With reference to FIGS. 5–8, a push-pull straight action clamp is illustrated with a release latch feature provided for the push mode clamp position shown in FIGS. 5 and 6. Base 52 is provided with integral linear bearing 53 for push-pull clamp element 54 actuated by a pair of side links 55 pivotally connected at 56 to clamp element 54 and pivotally connected at 57 to bifurcated handle 58 having extension 59 pivotally secured at 60 to integral boss 61 projecting upwardly from a base 52. Latch lever 62 is pivotally connected at 63 to the respective sides of bifurcated handle 58 actuated by hand pressure on pad 64 to clamping position shown wherein latch lever extension 65 engages recess projection 66 formed in base 52. Base lever 62 is biased toward latching engagement by tension spring 67 connected to release lever at 68 and handle crosspin at 69.

Release lever 62 is formed as a sheet metal element with a narrow portion 70 extending between handle sides being twisted at 71 to provide a flat portion 72 for convenient finger engagement in releasing clamp handle 58 from its push clamping position as illustrated in FIGS. 5 and 6. In this case, prepositioning is effected by spring biased engagement of latch lever surface 73 with bushing 74 on pivot pin 57.

Figure 9:
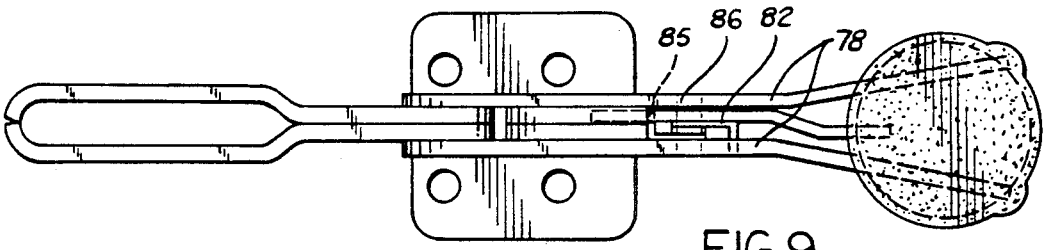
FIG. 9 is a plan view of an alternative hold down action clamp incorporating a modified latch lock in accordance with the present invention.
Figure 10:
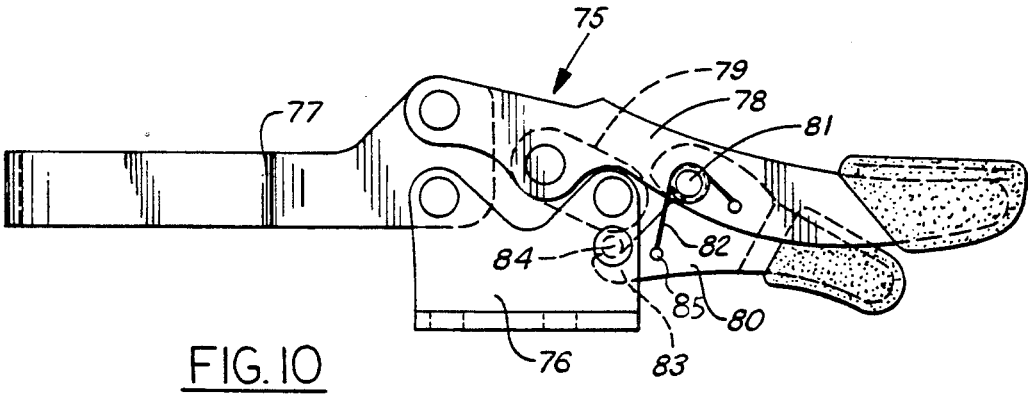
FIG. 10 is a side elevation of the clamp shown in FIG. 9.

With reference to FIGS. 9 and 10, hold down clamp 75 comprises base 76, clamp arm 77, bifurcated handle 78, toggle links 79 and latch release lever 80 pivotally connected at 81 to handle 78 with torque spring 82 urging latch engagement of latch end 83 with cross pin 84. Prepositioning of release lever 80 in this case, is effected by free position of torque spring end 85 engaging lever 80 below adjacent side 86 of handle 78.

Figure 11:
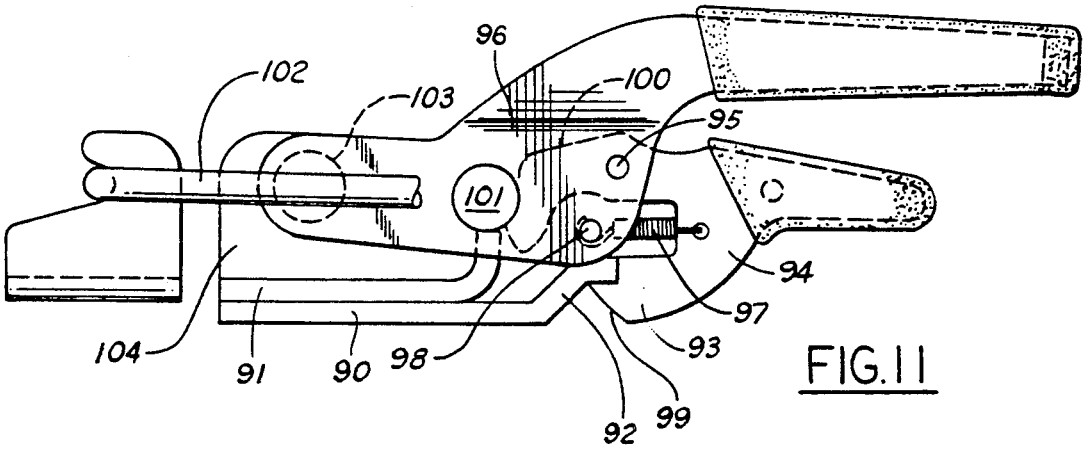
FIG. 11 is a side elevation of an alternative pull action latch clamp incorporating a modified latch lock in accordance with the present invention.

With reference to FIG. 11, subbase 90 is added to the bottom of standard base 91 to provide an extension 92 for engagement by latch end 93 of release handle 94, pivotally connected at 95 to bifurcated handle 96 and biased by tension spring 97, anchored at handle cross pin 98 to latching position shown after ramp surface 99 passes over projection 92. Prepositioning of release handle 94 is effected in this case by engagement of release handle extension 100 with U-bolt cross pin anchor 101, while handle 96 is raised to release U-bolt 102 through pivoting of handle 96 on pivot 103 secured in upright 104 of base plate 91.

I claim:

1. Toggle clamp with locking mechanism comprising base, toggle clamping mechanism mounted on said base including handle means with pivotally mounted bifurcated sides for actuating said clamp between clamping and release positions, locking lever pivotally mounted on said handle means between said bifurcated sides with manually releasible automatic means for locking engagement with said base responsive to handle movement to clamping position.

2. Handle clamp of claim 1 wherein said handle is pivotally mounted on said base.

3. Clamp of claim 2 wherein said clamp includes means to provide pull action.

4. Clamp of claim 2 wherein said clamp includes means to provide pull action through a U-bolt, having a cross pin passing through said handle.

5. Clamp of claim 4 wherein said lever is pivotally mounted on said cross pin.

6. Clamp of claim 4 wherein said lever is prepositioned on said cross pin.

7. Clamp of claim 6 including a subbase plate providing an extension for said locking engagement by said locking lever.

8. Clamp of claim 2 including a coiled spring acting between said lever and said handle adapted to bias said lever toward said locking engagement.

9. Clamp of claim 2 including means providing straight line clamping action.

10. Clamp of claim 9 including a guide in said base for push-pull clamp plunger.

11. Clamp of claim 10 wherein said bifurcated sides and locking lever are formed of relatively thin bar stock pivotally connected with major dimensions parallel to the plane of action, and wherein said lever is provided with a 90° twist to provide a flat finger actuated portion for finger release engagement.

* * * * *